United States Patent [19]

Stem

[11] Patent Number: 4,622,130

[45] Date of Patent: Nov. 11, 1986

[54] ECONOMIC COMBINATIVE SOLVENT AND CATALYTIC DEWAXING PROCESS EMPLOYING METHYLISOPROPYL KETONE AS THE SOLVENT AND A SILICATE-BASED CATALYST

[75] Inventor: Stephen C. Stem, Houston, Tex.

[73] Assignee: Shell Oil Company, Houston, Tex.

[21] Appl. No.: 806,308

[22] Filed: Dec. 9, 1985

[51] Int. Cl.[4] ..... C10G 53/02

[52] U.S. Cl. ..... 208/87; 208/18; 208/27; 208/33

[58] Field of Search ..... 208/87, 18, 33, 27, 208/113, 85

[56] References Cited

U.S. PATENT DOCUMENTS

| | | | |
|---|---|---|---|
| 3,684,691 | 8/1972 | Arey et al. | 208/59 |
| 3,702,886 | 11/1972 | Argauer et al. | 423/328 |
| 3,755,138 | 8/1973 | Chen et al. | 208/33 |
| 3,816,295 | 6/1974 | Coleman et al. | 208/86 |
| 3,902,988 | 9/1975 | Bennett et al. | 208/80 |
| 3,933,974 | 1/1976 | Winquist | 423/118 |
| 3,960,705 | 6/1976 | Garwood et al. | 208/111 |
| 4,033,855 | 7/1977 | Pütz | 208/33 |
| 4,088,564 | 5/1978 | Perry et al. | 208/33 |
| 4,216,075 | 8/1980 | Ryan | 208/33 |
| 4,259,170 | 3/1981 | Graham et al. | 208/33 |
| 4,259,174 | 3/1981 | Chen et al. | 208/87 |
| 4,343,692 | 8/1982 | Winquist | 208/111 |
| 4,357,232 | 11/1982 | Holland et al. | 208/87 |
| 4,358,363 | 11/1982 | Smith | 208/91 |
| 4,375,403 | 3/1983 | Harrison et al. | 208/33 |
| 4,437,975 | 3/1984 | Gillespie et al. | 208/87 |
| 4,447,311 | 5/1984 | Fowles et al. | 208/33 |
| 4,477,333 | 10/1984 | Hafez | 208/87 |

OTHER PUBLICATIONS

J. L. Tiedje and D. M. Macleod, "Higher Ketones as Dewaxing Solvents", Journal of the Institute of Petroleum, vol. 41 (Jan. 1955), pp. 37–43.

*Primary Examiner*—Andrew H. Metz
*Assistant Examiner*—Anthony McFarlane
*Attorney, Agent, or Firm*—Kimbley L. Muller

[57] ABSTRACT

This invention discloses an economic series flow dewaxing scheme having a first solvent dewaxing step followed by a catalytic dewaxing step. The use of methylisopropyl ketone as a key component in the solvent dewaxing step produces a solvent dewaxed effluent with an intermediate pour point which may be readily catalytically dewaxed to a pour point suitable for lubricant applications. The catalytic dewaxing unit can also be used to recover lost oil yield from the soft wax product of the solvent dewaxing zone (sometimes referred to as footsoil) and thereby sustain, if not increase, overall lubricating oil yield.

17 Claims, 2 Drawing Figures

SOLVENT RECOVERY ZONE
SOLVENT DEOILING UNIT
SOLVENT ADMIXTURE TANK
SOLVENT DEWAXING STEP
CATALYTIC DEWAXING STEP
BLENDING AREA
DEASPHALTING UNIT
FRESH METHYLISOPROPYL KETONE
FRESH TOLUENE
CRUDE
ATMOSPHERIC DISTILLATION
VACUUM DISTILLATION
HGO
LIGHT LUBE
MED. LUBE
HEAVY LUBE
DAO
ASPHALT
M,N,O,P
Q,R,S,T
U,V,W,X

ECONOMIC COMBINATIVE SOLVENT AND CATALYTIC DEWAXING PROCESS EMPLOYING METHYLISOPROPYL KETONE AS THE SOLVENT AND A SILICATE-BASED CATALYST

FIELD OF THE INVENTION

The field of this invention relates to dewaxing of lubricating oils containing a relatively high quantity of paraffinic wax, which renders the pour point of the lubricating oil unacceptable for its contemplated use. The dewaxing step in the preparation of a viable lubricating oil is the most expensive and troublesome step in preparation of same. To date, there are four generally accepted methods by which dewaxing can occur. First, a solvent dewaxing step can be undertaken with various solvents and mixtures of solvents such as aromatic hydrocarbons and ketones having lower alkyl groups existent on either side of the carbonyl moiety. Second, a catalytic dewaxing step can be undertaken in the presence of a molecular sieve catalyst. These catalysts are referred to as molecular sieves because they possess a consistent number of fungible pores to selectively admit long chain paraffinic molecules to selectively convert same to lighter hydrocarbons. Third, a combination solvent dewaxing and catalytic dewaxing procedure can be undertaken whereby first solvent dewaxing occurs followed by catalytic dewaxing. Fourth, urea can be contacted with the wax portion of the lubricating oil to react with the wax and thereby form a precipitate which frees the wax from the oil. This invention concerns only the third combinative method of dewaxing.

A cost analysis of a standard type of solvent dewaxing unit utilizing a mixture of methylethyl ketone and toluene as a solvent reveals that a large amount of heat and energy is required to recover both methylethyl ketone and toluene from the product streams of said solvent dewaxing unit. In practice, the solvent mixture of toluene and methylethyl ketone is driven from both the lube oil and the slack wax product stream. In an attempt to reduce this separation cost, a determination has been made that another ketone can be substituted for the methylethyl ketone without subjecting the overall combinative solvent and catalyst dewaxing process to a large decrease in oil yield.

BACKGROUND OF THE INVENTION

Nearly all of the lower aliphatic ketones, from acetone to dipentyl ketones, have been evaluated individually for the solvent dewaxing of lubricating oils. In an article by J. L. Tiedje and D. M. Macleod entitled "Higher Ketones as Dewaxing Solvents" in the early 1950's, three parameters which have an impact on the viability of these ketones were considered. J. L. Tiedje et al, Journal of the Institute of Petroleum, Vol. 41 (January 1955) pps. 37–43.

Essentially the authors teach that the three most important factors to consider in selecting a ketone, even one used in a pure state (i.e., no toluene), are: (1) the miscibility of the concerned aliphatic ketone with the lubricating oil, (2) the lowest possible solubility for wax in the concerned aliphatic ketones and (3) the highest filter rate possible to treat the oil-ketone effluent material.

From a miscibility standpoint the larger ketones were found to be better solvents than the smaller ketones, such as methylethyl ketone or acetone. The normal ketones were taught as preferred over the isoketones.

And, methylisopropyl ketone was specifically taught as being inferior for dewaxing relative to methyl-n-propyl ketone because of this miscibility temperature disadvantage. The smaller ketones have the lowest wax solubility and the highest dewaxing temperature for a given pour point. From a standpoint of wax solubility per se, acetone and methylethyl ketone were by far the best dewaxing solvents. However, in light of their determined high miscibility temperatures, the overall choice for a dewaxing solvent was methyl-n-propyl ketone followed by diethyl ketone and methylisobutyl ketone. Methylisopropyl ketone was noted as having the lowest wax solubility except for methylethyl ketone and acetone, which as above-mentioned, proved totally unsatisfactory in regard to its miscibility temperature. It was also determined that as molecular weight increased, a rapid drop in filter rate was observed. Consequently, the lighter ketones were found to possess the best filter rates with pure methylethyl ketone outperforming the other alkyl ketones. There was however no recognition or teaching of the viable use of methylisopropyl ketone in combination with a catalytic dewaxing technique, the latter of which was developed and refined subsequent to the date of this article. There was also no recognition or teaching of the viable use of methylisopropyl ketone in admixture with other components, e.g. aromatic hydrocarbons.

In 1975, U.S. Pat. No. 3,902,988 issued to Bennett et al, relating to a process for the production of a range of lubricating oils derived via splitting a petroleum fraction. The light fractions are treated by catalytic dewaxing and solvent extraction while the heavy fractions are treated by catalytic hydrogenation and solvent dewaxing. The lighter petroleum fractions are passed in the presence of hydrogen over a mordenite catalyst of crystalline configuration having incorporated therein either a Group VIA and/or Group VIII metal. The heavy petroleum fractions derived are subjected to catalytic hydrogenation and subsequently to solvent dewaxing. The solvents contemplated for the solvent dewaxing process are alkyl ketones wherein the alkyl groups possess from 1 to 4 carbon atoms. Of particular preference in the solvent dewaxing procedure are methylethyl ketone, methylisobutyl ketone and mixtures of the same. It is also taught that these ketones may be present with either benzene or toluene in an amount of from about 25 to about 75 weight volume of the total solvent. There was no recognition, however, that a catalytic dewaxing unit can be most advantageously utilized downstream of a solvent dewaxing unit using methylisopropyl ketone as one of the subject solvents with toluene.

In 1972, U.S. Pat. No. 3,684,691 issued to Arey Jr., et al, relating to a process for combinative catalytic and solvent dewaxing. The catalytic dewaxing transpires upstream of the solvent dewaxing step. Crystalline aluminosilicate zeolites convert normal paraffins in the hydrocarbon oil to products easily removed from the low pour point oil. The patentees actually reverse the sequence of dewaxing as this disclosure relates to the instant invention.

In 1974, U.S. Pat. No. 3,816,295 issued to Coleman et al, relating to a process for simultaneous solvent refinement of a vacuum residuum with hydrocracking to eliminate waxy materials. The catalytic dewaxing and solvent dewaxing are taught as disjunctive embodiments. The dewaxing agent in the solvent dewaxing step is taught as a mixture of 40 to 60% by volume of a ketone such as acetone, methylethyl ketone or normal butyl ketone and about 60 to 40 volume percent of an aromatic compound such as benzene or toluene.

In U.S. Pat. No. 3,755,138 a combinative solvent and catalyst dewaxing unit is disclosed with the solvent dewaxing occurring upstream of the catalyst dewaxing process with the solvent dewaxing being carried out by well-known techniques, i.e. use of methylethyl ketone-toluene; methylethyl ketone-methylisobutyl ketone. There is a total lack of appreciation of using (and the advantages derivative thereof) a dewaxing solvent consisting of pure methylisopropyl ketone or methylisopropyl ketone in admixture with an aromatic hydrocarbon upstream of catalyst dewaxing.

In U.S. Pat. No. 3,960,705, a method of converting Foots oil (the by-product of a high quality wax dewaxing process) is disclosed to prepare a higher quality lubricant by subjecting same to catalytic hydroprocessing with a ZSM-5 zeolite under hydrogen pressure with downstream distillation. The preliminary ketone extraction is usually performed in the presence of methylethyl ketone; no awareness is evidenced or any generic or specific teaching is existent of the beneficial interaction of use of methylisopropyl ketone as the solvent dewaxing ketone in conjunct association with downstream Foots oil hydrocatalytic conversion to produce an oil of higher quality.

In conclusion, these prior disclosures have failed to teach or appreciate an energy efficient process derived from the combinative use of methylisopropyl ketone as the solvent (in conjunction with an aromatic hydrocarbon if so desired) when solvent dewaxing is employed in series, upstream and concomitant with catalytic dewaxing.

OBJECTS AND EMBODIMENTS OF THE INVENTION

It is an object of this invention to provide a combinative solvent and catalytic dewaxing process which is more energy efficient and yet produces a lubricating oil of comparable quality without a large decrease in oil yield.

It is a further object of this invention to utilize methylisopropyl ketone as the solvent in a solvent dewaxing step followed in series by a catalytic dewaxing step to produce a dewaxed lubricating oil.

It is yet another object of this invention to provide a unique solvent dewaxing process utilizing methylisopropyl ketone which will derive, after applicable separations, a soft wax substrate having lubricating oil therein, which is passed to a catalytic dewaxing unit for removal of wax materials from, and thereby recovery of, an additional amount of lubricating oil.

In one embodiment of this invention a process is disclosed for an economic combinative solvent and catalytic dewaxing process to produce a dewaxed lubricating oil which comprises first, solvent treating a paraffinic wax-containing lubricating oil, at solvent treating conditions, with a solvent comprising methylisopropyl ketone in admixture with an aromatic hydrocarbon to produce a solvent dewaxing product stream containing solvent and partially dewaxed lubricating oil and a slack wax stream containing said solvent and said paraffinic wax compounds; separating said solvent dewaxing product stream from said slack wax stream; and, after removing the solvent, catalytically treating said partially dewaxed lubricating oil in a catalytic treating zone in the presence of a dewaxing catalyst at catalytic treating conditions to produce a dewaxed lubricating oil.

Another embodiment of this invention resides in a process for the combinative dewaxing of a paraffinic wax-containing lubricating oil which comprises contacting the lubricating oil with a solvent comprising methylisopropyl ketone to dewax, at solvent dewaxing conditions, the lubricating oil and produce a slack wax stream containing hard wax, soft wax having lubricating oil therearound and a solvent stream comprising methylisopropyl ketone, which may be recycled to further solvent dewaxing. In this preferred embodiment the partially dewaxed lubricating oil from the solvent dewaxing zone is contacted with a dewaxing catalyst in a catalytic dewaxing zone at catalytic dewaxing conditions to produce a dewaxed lubricating oil. The aforementioned soft wax having lubricating oil therearound in this embodiment is separated from the said slack wax and is selectively passed to the aforementioned catalytic dewaxing unit or to a separate catalytic dewaxing unit to increase the overall quantity of lubricating oil produced and to convert the wax compounds to compounds lighter than lubricating oils.

SUMMARY OF THE INVENTION

This invention concerns an economic combinative solvent and catalytic dewaxing process wherein solvent dewaxing is performed in the presence of methylisopropyl ketone while the catalytic dewaxing step is performed in the presence of a crystalline molecular sieve catalyst. As an alternative embodiment of this invention an aromatic hydrocarbon may be used in admixture with the methylisopropyl ketone.

DETAILED DESCRIPTION OF THE INVENTION

This invention resides in a more viable pecuniary combinative solvent and catalytic dewaxing process. Applicant has discovered that the advent of precise catalytic dewaxing will now economically permit use of methylisopropyl ketone as a solvent in the solvent dewaxing step and thereby mitigate separation problems of the solvent with a partially dewaxed lubricating oil. Recent developments in catalytic dewaxing used downstream of a solvent dewaxing unit have been found to negate the intrinsic weakness of heavier ketone solvent dewaxing, and especially use of methylisopropyl ketone vis-a-vis the use of methylethyl ketone.

The use of methylisopropyl ketone as a solvent in the solvent dewaxing stage will result in energy conservation because of two factors. First, the methylisopropyl ketone requires less heat to elevate its temperature from 80° F. to complete evaporation. With respect to the lower ketones (such as acetone and methylethyl ketone), this is due to the favorable heat of vaporization of methylisopropyl ketone. With respect to the higher ketones (such as methyl n-propyl ketone and methylisobutyl ketone) this is due to the favorable boiling point of methylisopropyl ketone. These advantageous physical properties mean that methylisopropyl ketone requires less energy input when it is driven off the partially dewaxed lube oil and when it is driven off the slack wax stream which contains hard wax, soft wax, together with lubricating oil. This factor is tabulated in Table II hereinafter discussed.

The second way that the use of methylisopropyl ketone results in energy conservation, relative to conventional dewaxing with methylethyl ketone, is by reducing toluene admixture. This reduction directly impacts the energy consumed during the solvent recovery step. But beyond energy conservation, reducing toluene admixture also results in a net reduction in solvent-to-feed ratio which favorably impacts other aspects of solvent dewaxing. To appreciate this impact, it must be understood that the dewaxing of a lubricating oil will vary depending on the viscosity and molecular structure of the oil which necessitates dewaxing. Essentially four lubricating oil precursor streams are usually formed from a crude oil in a vacuum distillation column including a light lube oil (HVI 80–150), a medium lube oil (HVI 250–300), a heavy lube oil (HVI 500 to 600), and a bright stock oil (a deasphalted bottoms stream). When a conventional solvent, such as a mixture of methylethyl ketone and toluene, is used in dewaxing the HVI 80–150 lube oil stream, the process is frequently bottlenecked by refrigeration capacity. When same is used to dewax an HVI 250–300 lube oil stream the process is frequently bottlenecked by the solvent recovery system. When this solvent is used to dewax the HVI Heavy lube oil and HVI Bright Stock oil, the process is frequently bottlenecked as a result of the limit in the filtration rate. In accordance with this invention, methylisopropyl ketone is substituted for methylethyl ketone. This results in a reduced requirement for toluene and a net reduction in solvent-to-feed ratio. This lower solvent-to-feed ratio reduces refrigeration requirements and conceivably debottlenecks the HVI 80–150 solvent dewaxing procedure. The reduction in solvent-to-feed ratio also reduces the load on the solvent recovery section of the process and conceivably debottlenecks the HVI 250–300 dewaxying step. In the dewaxing of the HVI 500 to 600 and HVI Bright Stock lube oils, debottlenecking is also surprisingly conceivable due to an improved filtration rate derivative of use of the instant methylisopropyl ketone as shown in Table I hereinafter discussed.

Methylisopropyl ketone, like methylethyl ketone, boils at a temperature below the boiling point of toluene. Thus, existing solvent recovery equipment in an existing methylethyl ketone solvent dewaxing unit can be used without modification in the proffered switch to methylisopropyl ketone. A dewaxing refiner need only change the inventory of the lower alkyl ketone, (which has many other uses after proper clean-up), and substitute for the same methylisopropyl ketone, which can be purchased on open commercial chemical markets and is a common chemical used in dyeing of textiles. As all solvent dewaxing units loose small amounts of solvent over time, it is possible to simply blend in the methylisopropyl as replacement of lost methylethyl ketone. In this manner a gradual change-over to the new solvent is realized with an avoidance of a one-time large capital expenditure.

As shown in the instant drawings, this invention concerns only a combinative solvent and catalytic dewaxing process, and not the individual process steps per se. First, the lubricating oil containing the troublesome $C_{15}$ to $C_{52}+$ paraffinic hydrocarbons are treated with methylisopropyl ketone in possible admixture with an aromatic hydrocarbon to produce a partially dewaxed lubricating oil. The lubricating oil which necessitates dewaxing can be any of four streams or a mixture of four streams derived from a vacuum distillation column after an appropriate intermediate treatment by solvent extraction, hydrotreating and the like (not shown on instant drawing). The aromatic hydrocarbon is preferably benzene or toluene but can be any other aromatic hydrocarbon such as xylene, cumene, isopropylbenzene, pseudocumene, alkyl benzenes having from 1 to 10 carbon atoms in the alkyl groups, naphthalene, alkylnaphthalenes, having from 1 to 4 carbon atoms in the alkyl group, etc.

The solvent treatment occurs at solvent treating conditions which include a filtration temperature below about 20° F. and a solvent to waxy lubricating oil ratio of 0.5:1 to 5:1 by volume. The methylisopropyl ketone is present in admixture with the aromatic hydrocarbon in a relationship of about 25% to about 99% volume methylisopropyl ketone versus 75% to 1% volume of the aromatic hydrocarbon i.e., 25:75 to 99:1. A derivative advantage of use of the methylisopropyl ketone is use of a relatively smaller amount of toluene or other aromatic hydrocarbon. It is therefore preferred that the volume percent of the aromatic hydrocarbon be kept at a minimum. It is conceivable that as much as 99% by volume of the solvent is methylisopropyl ketone and 1% by volume is the aromatic hydrocarbon. It is also feasible that the aromatic hydrocarbon not be used at all and that the methylisopropyl ketone be used neat as the only solvent. This is particularly likely when only the lighter waxy feeds are solvent dewaxed because it is generally the heaviest waxy feed that requires the greatest aromatic proportion.

The effluent from the solvent dewaxing zone or zones comprises a solvent dewaxing product stream containing solvent and partially dewaxed lubricating oil and a slack wax stream containing solvent, hard wax and soft wax having lubricating oil contained therewith. The latter is sometimes referred to as "footsoil" which exists as an oily suspension. After separation of the partially dewaxed lubricating oil from the solvent in the solvent dewaxing product stream for its intended journey to the catalytic dewaxing step, the slack wax stream is further treated in an additional separation zone, referred to by the industry as solvent deoiling, to excise hard wax from the soft wax and thereby acquire streams containing only hard wax with solvent and soft wax with solvent. These latter entities are treated to bifurcate the same. It is well to note that some solvent deoiling units are close-coupled to solvent dewaxing units and share solvent circulation systems. Other solvent deoiling units are independent of solvent dewaxing and sometimes employ a different ketone altogether than used in dewaxing. These considerations are irrelevant to the present invention. The soft wax is cycled to a catalytic dewaxing step either in association with the partially dewaxed lubricating oil or as a separate stream going to the same or a different catalytic dewaxing unit. In this manner, the soft wax is treated with either the same or a different catalyst than the partially dewaxed lube oil stream. It is feasible that the soft wax can be passed to any combination of catalysts utilized in dewaxing of various lube oils to provide a process to selectively dewax the soft wax in conjunct association with the dewaxing of another type of lubricating oil. The large amount of paraffinic materials existent in the soft wax is nearly completely converted to other lighter hydrocarbons thus rendering all of the lubricating oil in the soft wax available as product after applicable conventional separation.

The methylisopropyl ketone and toluene undergo flashing, distillation, or stripping to recover the respective methylisopropyl ketone and toluene from the aforementioned effluent streams. They are thereafter admixed in desired volume for charge back to the solvent dewaxing step or added to the waxy lubricating oil which itself is charged to the solvent dewaxing step.

After acquisition of the partially dewaxed lubricating oil from the solvent dewaxing step, and, after removal of the solvent therein, a second procedure inclusive of catalytic dewaxing is performed on the lubricating oil. This will derive a nearly completely dewaxed lubricating oil by converting any remaining large paraffinic molecules to many smaller molecules. Removal of the smaller molecules will greatly modify the pour point of the lube oil and render it commercially viable for its intended use, i.e. as an internal combustion engine lubricating agent, railroad lubricating oil, diesel engine lubricating oil, transmission oil, refrigeration oil, electrical oil, aviation oil, etc.

The partially dewaxed lubricating oil is substantially dewaxed in the presence of a dewaxing catalyst at catalytic treating conditions which include a temperature from about 450° F. to about 900° F. and a pressure of from about 7 atmospheres to about 205 atmospheres. The catalytic composition of matter may be selected from any viable silicate-based dewaxing catalyst such as mordenite, ZSM-5 zeolite, ZSM-35 zeolite, ZSM-38 zeolite, ZSM-21 zeolite, or a natural or synthetic ferrierite having catalytic metals incorporated therein. Reference is herein made to U.S Pat. No. 3,933,974, all the teachings of which are herein incorporated by reference, which shows a method of preparing a synthetic ferrierite useful in a dewaxing step. Also, U.S. Pat. No. 4,343,692, all of the teachings of which are also herein incorporated by reference, teaches use of a catalytic hydrodewaxing catalyst comprising a synthetic ferrierite having incorporated therewith at least one metal selected from the group consisting of Group VIB, Group VIIB and Group VIII metals. In addition, ZSM-5 patents are exemplified by U.S. Pat. Nos. 3,702,886, 4,358,363, 4,357,232 and a plethora of other catalytic dewaxing processes and catalysts assigned to the Mobil Oil Company. The catalytic composition of matter may also be selected from any viable non-aluminosilicate dewaxing catalyst such as borosilicates.

The effluent from the catalytic dewaxing step is sufficiently free of paraffinic wax material that the lubricating oil effluent has a commercially acceptable pour point. These streams such as the dewaxed light, medium, heavy and bright stock lubricating oils may be blended in any quantity to acquire the most desirable lubricating oil product for the intended use.

DETAILED DESCRIPTION OF THE DRAWING

Figure 1:
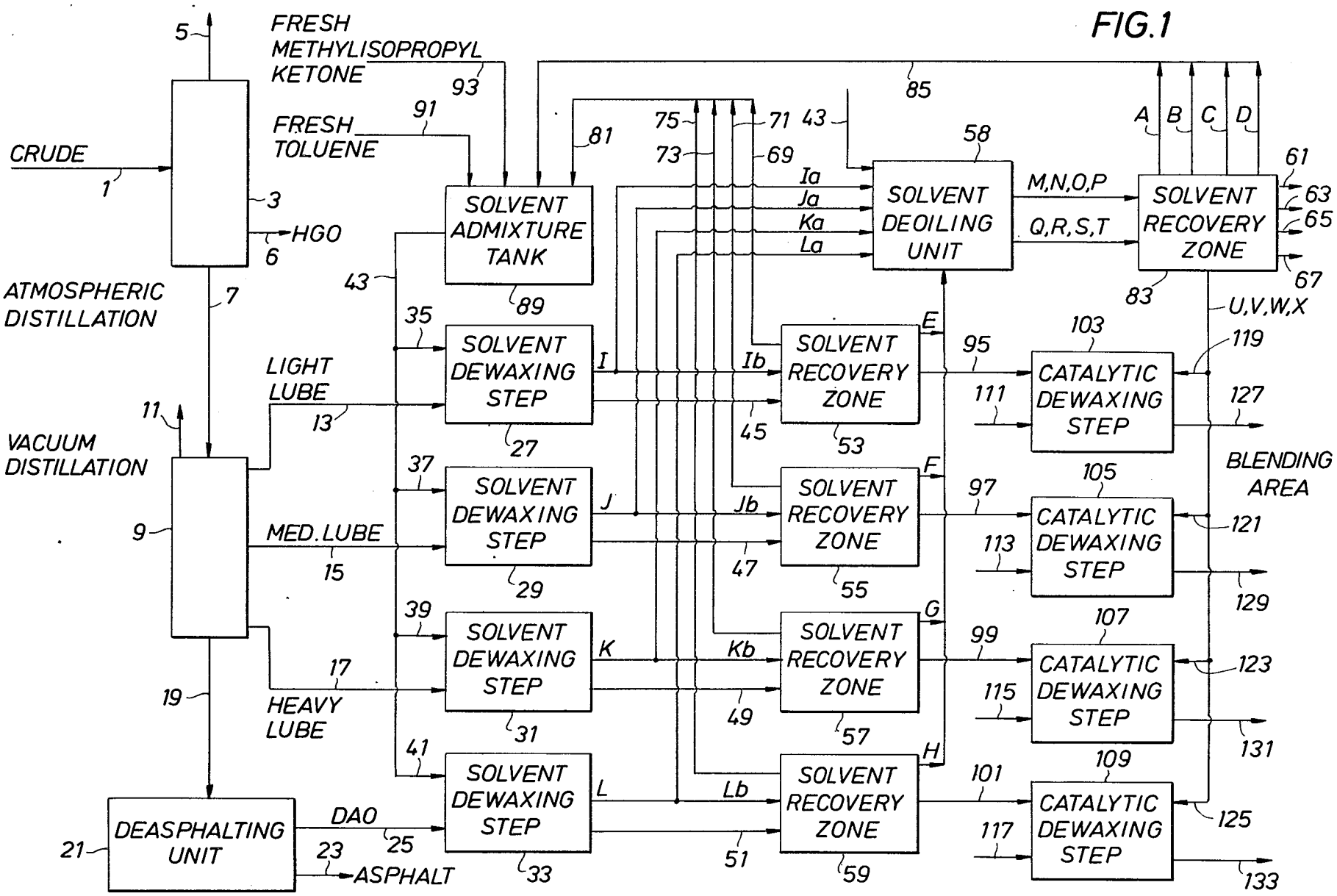
FIGS. 1 and 2 are flow schemes exemplary of different embodiments of the instant combinative solvent and catalytic dewaxing process.

The lubricating oils desired in this process are all indigenous to crude oil stream 1 which is charged at proper separation conditions to atmospheric distillation column 3 as shown in FIG. 1. Therein three streams are formed, an overhead stream 5 containing materials lighter than heavy gas oil which is further processed to recover the materials contained therein, a bottoms stream 7 which contains materials heavier than Heavy Gas oil and which is charged to vacuum distillation column 9, and a heavy gas oil which is removed from atmospheric column 3 by means of conduit 6 to be further processed for its indigenous hydrocarbon qualities. Column 9 is maintained at conditions to preferably form five streams. First overhead cut 11 contains hydrocarbon materials which are likewise further processed for their indigenous hydrocarbon qualities. A light lube distillate 13, a medium lube distillate 15, a heavy lube distillate 17 and a vacuum distillation bottoms stream 19 are all withdrawn from vacuum distillation unit 9. The latter is charged to deasphalting unit 21 for removal of asphalt in conduit 23 and the production of deasphalted oil (DAO), in conduit 25.

These respective four raw lubricating oil distillate streams contain paraffinic materials which render them unsuitable for their intended use. Aromatic molecules, sulfur-containing molecules, and nitrogen-containing molecules, may also be present at this point in the flow scheme and may, if desired, be extracted by solvent extraction or chemically altered by high (or even) medium severity hydrotreating. The solvent extraction and hydrotreating steps are not shown in FIG. 1. If solvent extraction is performed, the distillates become known as "waxy raffinates". Following solvent extraction, "deasphalted oil" becomes known as "bright stock waxy raffinate". This invention treats these four streams in a combinative solvent and catalytic dewaxing step to obtain the desired dewaxed lubricating oils. Each of these streams in conduits 13, 15, 17 and 25 are respectively charged to solvent dewaxing stages 27, 29, 31 and 33. The solvent added can be virgin solvent or recycled solvent recovered downstream of the solvent dewaxing step. The solvent is methylisopropyl ketone in association with an aromatic materials e.g. toluene. These solvents are added to respective solvent dewaxing stages 27, 29, 31 and 33 via conduits 35, 37, 39 and 41. And the latter are derived from manifold 43 which services all of the solvent dewaxing zones. It is contemplated that each of the streams be individually or batchwise solvent dewaxed through any number of separate solvent dewaxing zone or zones. It is also considered within the scope of this invention to commingle any of these streams and solvent dewax in a common unit, in which case less than four solvent conduit entry points are necessary in the solvent dewaxing stage.

Partially dewaxed lubricating oil combined with solvent from the respective solvent dewaxing steps is withdrawn from same in conduits 45, 47, 49 and 51 and passed to solvent recovery stages 53, 55, 57 and 59. Slack wax streams I, J, K, and L containing a combination of hard wax, soft wax with lube oil therearound, and solvent can optionally bypass solvent recovery zones 53, 55, 57, and 59 and be passed directly to solvent deoiling unit 58 (via conduits Ia, Ja, Ka, and La). Or, these streams can go first to the solvent recovery zones 53, 55, 57 and 59 (via conduits Ib, Jb, Kb, and Lb), and then proceed to solvent deoiling unit 58 as streams E, F, G, and H. The hard wax may be removed from the respective solvent deoiling separation zones via streams M, N, O, and P. Solvent is removed from both the hard wax streams and the soft wax streams, shown in FIG. 1 as Q, R, S, T, in Solvent Recovery Zone 83. Solvent Recovery Zone 83 may comprise multiple discrete zones. Hard wax is removed from respective separation zones and from the entire process in conduits 61, 63, 65 and 67.

The recovered solvent is recycled in respective solvent recycle conduits 69, 71, 73 and 75 and all are passed to solvent admixture tank 89 by conduit 81 in which fresh or virgin aromatic hydrocarbon in conduit 91 or fresh or virgin methylisopropyl ketone in conduit 93 may, if necessary, be charged thereto. The desired solvent is then admixed to the proper specification and charged to manifold 43 for passage to respective dewaxing units 27, 29, 31 and 33.

It is also contemplated that solvent streams A, B, C and D can be optionally recycled to the feed of the solvent deoiling step or recycled to solvent admixture tank 89 from solvent recovery zone 83 by means of conduit 85 or conduit 85 and conduit 43.

Returning now to the description of the solvent recovery procedure, a partially dewaxed lubricating oil is withdrawn from solvent recovery zone 53 in conduit 95, from solvent recovery zone 55 in conduit 97, from recovery zone 57 in conduit 99, and solvent recovery zone 59 in conduit 101. The remaining portion of the undesirable wax in the partially dewaxed lubricating oil is passed through these conduits and is catalytically dewaxed in catalytic dewaxing units 103, 105, 107 and 109. It is also contemplated within the scope of this invention that these streams may be commingled and treated in a unitary catalytic dewaxing zone. Each of these zones can contain one or a variety of dewaxing catalysts as specifically incorporated by reference to this specification by one or more of the above noted incorporated U.S. patents. Hydrogen is supplied to the respective catalytic dewaxing via conduits 111, 113, 115 and 117. It is also contemplated that an optional hydrofinishing unit may be placed in conduits 127, 129, 131 and 133 in order to convert sulfur-containing compounds, and nitrogen-containing to more desirable compounds and to convert molecules with multiple aromatic rings to molecules with fewer aromatic rings.

Returning now to a description of the solvent deoiling step, the streams consisting of the combination of solvent, hard wax, and soft wax with lubricating oil therearound, enter the solvent deoiling step wherein hard wax together with solvent is respectively separated into streams M, N, O, and P and soft wax combined with lubricating oil and solvent are separated into streams Q, R, S, and T as aforementioned. These streams may be combined in a unitary stream (as shown on drawing) or they may be unique individual streams traversing from solvent deoiling unit 58 to solvent recovery zone 83.

One important aspect of this invention is the acquisition of a soft wax stream in unit 83, from which are withdrawn said soft wax streams. These may be unitary (as shown) or individual streams U, V, W, and X. These soft wax streams are withdrawn from the solvent recovery zone and passed to catalytic dewaxing via conduits 119, 121, 123 and 125 all of which communicate with catalytic dewaxing units 103, 105, 107 and 109. It is preferred that all of the soft wax be added to these respective catalytic dewaxing units so that the wax containing material (40 weight percent wax would not be uncommon) of the soft wax stream can be converted to lower boiling hydrocarbons and thereby render salvageable the lubricating oils associated with the soft wax. The resultant dewaxed product is withdrawn from dewaxing steps 103, 105, 107 and 109 in conduits 127, 129, 131 and 133 with enough wax removed therefrom such that pour point targets can be met. These streams may be individually used, they may be hydrofinished or they may be blended to acquire the proper lubricating oil for desired use.

Figure 2:
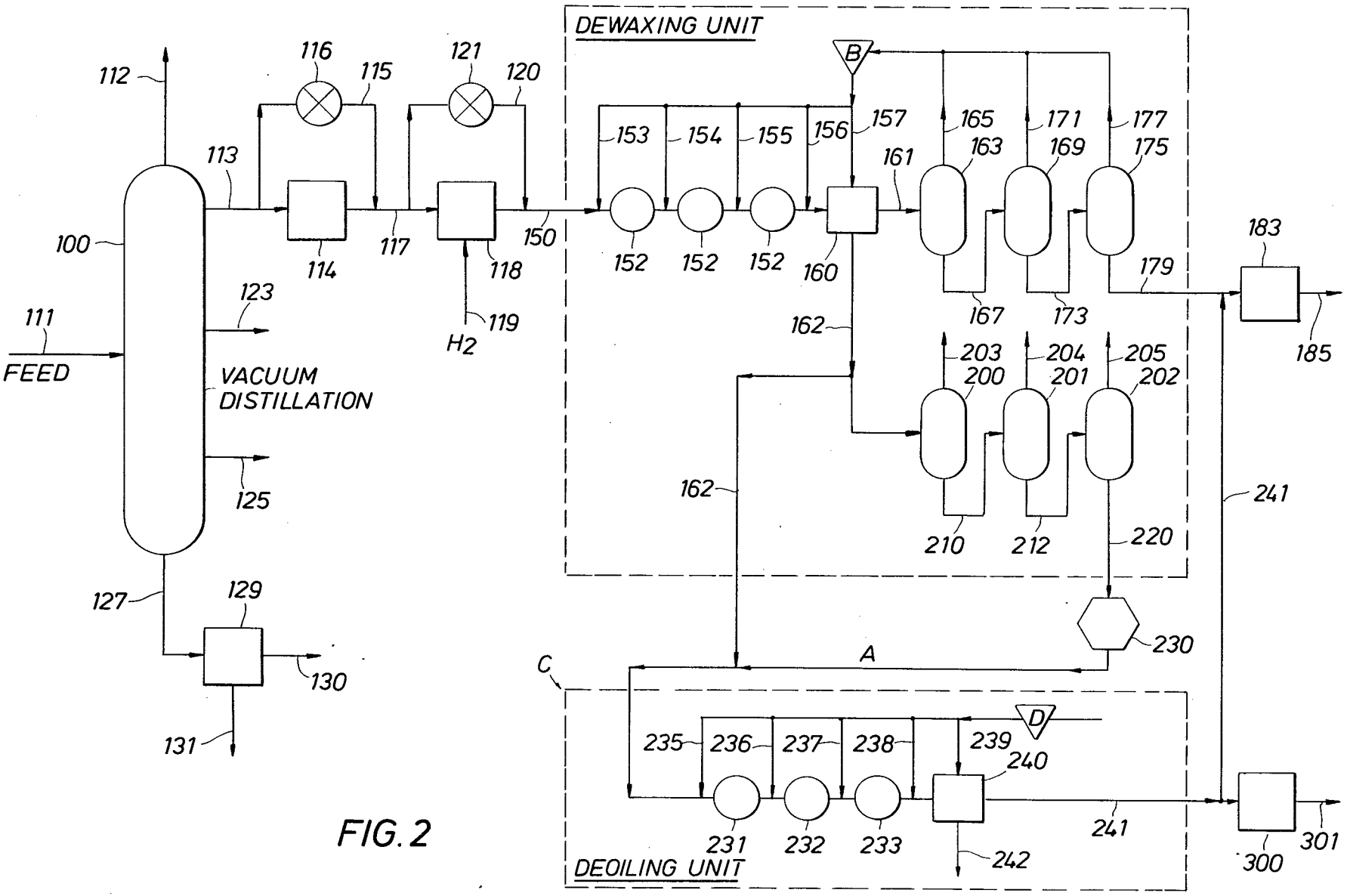

In FIG. 2 vacuum distillation column 100 has a feed stream 111 charged thereto consisting of oils heavier than heavy gas oil. A light vacuum gas oil 112 is removed as the upflow of the vacuum distillation column. An HVI 80–150 light lubricating oil distillate is withdrawn in conduit 113 and passed to a solvent extraction unit 114 comprising furfural, phenol or N-methyl-2-pyrrolidone extraction solvent to remove aromatic compounds, sulfur-containing compounds and nitrogen-containing compounds. If desired, the HVI 80–150 light lubricating oil can bypass solvent extraction zone 114 by means of conduit 115 and control valve 116. The extracted HVI 80–150 light lube oil distillate is removed from extraction zone 114 or acquired from bypass stream 115 in conduit 117, wherein it is passed to hydrotreating zone 118 having means for admission of hydrogen in conduit 119. It is possible to also bypass this hydrotreating step via conduit 120 and control valve 121. An HVI 250–300 medium lube oil distillate is withdrawn in conduit 123 and processed as above set forth in a similar flow scheme. Likewise, an HVI Heavy (500 to 600) lube oil distillate can be removed from vacuum distillation column 100 in conduit 125 and processed as hereinabove contemplated. The bottoms stream of the vacuum distillation column 100 passes residual material in conduit 127 to a deasphalting step 129 to provide a deasphalted oil in conduit 130 and an asphalt-rich stream in conduit 131. The deasphalted oil can likewise be treated to recover their mineral properties if so desired.

Returning now to the discussion of the treatment of the HVI 80–150 light lubricating oil, the same is removed from the hydrotreating unit 118 (or acquired from bypass conduit 120) in conduit 150. The same is passed to cooling and chilling hardware 152 which is provided with multiple injection points of recycle methylisopropyl ketone and aromatic solvent in conduits 153 through 157. The waxy lubricating oil and recycle solvent are charged to filtration zone 160 to produce a partially dewaxed oil in accompaniment with dewaxing solvent which is withdrawn in conduit 161 and a slack wax stream composed of hard wax, soft wax and solvent withdrawn in conduit 162. The partially dewaxed lubricating oil is passed to flash vessel 163 to remove mostly methylisopropyl ketone although small quantities of aromatic hydrocarbon and water are also removed, all of which is passed to conduit 165. The underflow from flash vessel 163 is withdrawn in conduit 167 and passed to a second flash vessel 169 which can contain various flash trays for further separation of the solvent in conduit 171. This removed solvent is mostly aromatic hydrocarbon with some methylisopropyl ketone. The underflow of flash vessel 169 is removed in conduit 173 and passed to stripper unit 175 which uses steam or gas to remove residual solvent (mostly aromatic solvent) which is removed from the stripper unit in conduit 177. Conduits 165, 171, and 177 flow to vessels shown as B suitable for storage and blending of recycled solvent. The underflow of stripper unit 175 contains totally or partially dewaxed oil withdrawn through conduit 179 and passed to catalytic dewaxing unit 183 for the production of a near totally dewaxed lubricating oil removed from the process in conduit 185. Catalytic dewaxing unit 183 can contain any viable dewaxing catalyst.

Returning now to the discussion of the underflow of filtration unit 160 acquired in conduit 162, the same is passed to multiple vessels 200, 201, or 202 for the separation of respective solvent streams 203, 204, and 205. The purpose of vessels 200, 201 and 202 is identical to the purpose of vessels 163, 169, 175 hereinabove described. The underflow of flash vessel 200 communicates with flash vessel 201 via conduit 210 while the underflow of flash vessel 201 communicates with stripper vessel 202 via conduit 212. The underflow of stripper vessel 202 is passed as slack wax in conduit 220 to tankage for further transportation represented generically by FIG. 230. From tankage, slack wax is charged via conduit A to deoiling unit C. In an alternative embodiment of this invention, conduit 162 (underflow of filtration unit 160) can be added directly to deoiling unit C, which begins with chilling and cooling hardware depicted by vessels 231, 232, and 233 having appropriate entry of secondary solvent, which is methylisopropyl ketone and toluene or another basic ketone solvent (such as methyethyl ketone or acetone in conjunction with another aromatic compound). These injection points represented by conduits 235, 236, 237, 238, and 239 are interconnected with a common manifold not shown herein. Chilled slack wax stream is added to filtration unit 240 to produce soft wax stream 241 in accompaniment with deoiling solvent and hard wax stream 242 in accompaniment with deoiling solvent. Both of these streams are passed to solvent recovery vessels like those described hereinabove as 163, 169 and 175. The recovered solvent is charged to appropriate blending and storage vessels shown as D. The soft wax stream is passed to a catalytic dewaxing unit 300 for production of a dewaxed lubricating oil stream 301 or it may be passed to admixture with the partially dewaxed oil being added to the catalytic dewaxing step 185. Catalytic dewaxing unit 300 can contain any viable dewaxing catalyst. Hard wax is recovered in conduit 242.

It is contemplated that FIGS. 1 and 2 have removed therefrom all of the ancillary equipment of the process, which are not necessary for an understanding of the instant flow scheme, such as various pumps, condensers, heat exchangers, etc.

light of its superior miscibility characteristics relative to methylethyl ketone. And it is this latter characteristic of the methylisopropyl ketone solvent which results in much of the energy savings of the solvent dewaxing step when combined with the catalytic dewaxing unit. The remainder of the energy savings being the result of the lower heat of vaporization of methylisopropyl ketone.

The dewaxings were all performed at 0° F. filtration temperature. The filtration times were found to be greatly reduced using the methylisopropyl ketone which could result in the debottlenecking of a solvent dewaxing process, especially with respect to HVI Bright Stock and HVI Heavy lubricating oils. The oil yield was found to be higher in the case of the methylethyl ketone vis-a-vis the instant methylisopropyl ketone, however, the yield has to be viewed in light of the subsequent catalytic dewaxing, which will recover all oil lost to the soft wax stream due to methylisopropyl ketone presence.

Table 1 as follows indicates, in tabular format, the results of these five tests. In summary of this data, it can be seen that Test A was the standard base case utilizing the 50:50 methylethyl ketone-toluene volume proportion while Tests B and C were run utilizing the methylisopropyl ketone. Test D shows a light increase in the solvent-to-oil ratio while holding unchanged the toluene-to-oil ratio. The yields did not improve in Run D and the conditions were repeated in Run E except for the temperature of the secondary feed addition was 5° F. colder. The results of Run E were consistent with Test Runs B and C and were substantially better than those of Test Run D.

This highlights the significance of the temperature of the secondary feed addition and identifies another avenue for improving dewaxing with methylisopropyl ketone without sacrificing the energy savings and throughput gains.

TABLE I

Substitution of Methylisopropyl Ketone (MiPK) For Methylethyl Ketone (MEK) in the Dewaxing of a Bright Stock Waxy Raffinate

| Run Designation | A | B | C | D | E |
|---|---|---|---|---|---|
| Run Description | Base Case | MiPK Case | MiPK Case | Raise Net MiPK Amount Slightly Hold Net Toluene Amount Fixed | |
| Solvent-to-Feed Ratio (Volume) | 2.7 | 2.3 | 2.3 | 2.4 | 2.4 |
| Temp. of Secondary Feed Addition | 180° F. | 180° F. | 180° F. | 180° F. | 175° F. |
| MiPK Proportion of Solvent | 0 | 70% v | 70% v | 71% v | 71% v |
| MEK Proportion of Solvent | 50% v | 0 | 0 | 0 | 0 |
| Toluene Proportion of Solvent | 50% v | 30% v | 30% v | 29% v | 29% v |
| Filtration Time (No wash) | 10.8 sec. | 7.5 sec. | 8.9 sec. | 11.1 sec. | 8 sec. |
| Filtration Rate (g of oil/sec) | 12.7 | 17.1 | 15.5 | 11.9 | 16.7 |
| Oil Yield | 69.7% wt | 66.9% wt | 69.0% wt | 66.3% wt | 68.9% wt |
| Oil Pour Point | +15 | +15 | +10 | +10 | +15 |
| Wax Melt Point | 169° F. | 166° F. | 168° F. | 168.5° F. | 167.5° F. |
| Dewaxing Aid Concentration | 200 ppm | 200 ppm | 200 ppm | 200 ppm | 200 ppm |
| Filtration Temperature | 0° F. | 0° F. | 0° F. | 0° F. | 0° F. |

ILLUSTRATIVE EMBODIMENT

In this illustrative embodiment a simple comparative run was made utilizing methylethyl ketone in comparison with methylisopropyl ketone to show the economic incentive to resort to the methylisopropyl ketone without loss of lubricating oil quality and without large loss in yield.

Five tests were run labeled Experiments A through E in a dewaxing pilot plant on a bright stock waxy raffinate which had been deasphalted and solvent extracted. The proportion of toluene to the respective ketone was reduced in the case of the methylisopropyl ketone in In order to determine the energy efficiency of the various ketones, a survey was made of the relative heats of recovery of these potential solvent dewaxing ketones. These are listed in Table 2. Thus, if these ketones are compared on the basis of the heat required to warm each ketone from 80° F. to complete vaporization at 1 atmosphere pressure, methylisopropyl ketone stands out clearly as requiring the least heat input per liquid volume. Thus, it is unexpectedly found to be the most energy efficient ketone when coupled with catalytic dewaxing. Again, this summation should also be viewed in light of the fact that the higher ketones require less toluene in the solvent mix than methylethyl ketone.

TABLE II

| | Relative Heats of Recovery of Potential Dewaxing Ketones | | | | |
|---|---|---|---|---|---|
| | Boiling Point at 1 Atm (°F.) | Heat of Vaporization at 1 Atm Boiling Point (Btu/lb) | Average Heat Capacity between 80° F. and Boiling Point at 1 Atm (Btu/lb F.) | Density at 0° F. (lb/ft$^3$) | Heat Required to Warm and Vaporized 1 ft$^3$ of Liquid Ketone from 80° F. at 1 Atm (Btu/ft$^3$) |
| Acetone | 133.1 | 225.7 | (0.157 + 0.525)/2 | 52.11 | 13204 |
| Methyl Ethyl Ketone (MEK) | 175.3 | 185.9 | (0.519 + 0.558)/2 | 55.65 | 12489 |
| Methyl Isopropyl Ketone (MiPK) | 201.9 | 166.6 | (0.513 + 0.565)/2 | 52.33 | 12157 |
| Methyl n-Propyl Ketone | 217.6 | 166.5 | (0.520 + 0.576)/2 | 52.64 | 12732 |
| Methyl Isobutyl Ketone (MiBK) | 240.8 | 157.0 | (0.500 + 0.579)/2 | 52.03 | 12682 |
| Ethyl Ketone | 215.6 | 168.7 | (0.531 + 0.5835)/2 | 53.02 | 12948 |
| Methyl n-Butyl Ketone | 261.9 | 153.6 | (0.500 + 0.585)/2 | 52.45 | 13233 |
| Cyclohexanone | 312.2 | 173.6 | (0.439 + 0.5517)/2 | 61.17 | 17652 |
| Toluene | 231.1 | | | | |

I claim as my invention:

1. An economic combinative solvent and catalytic dewaxing process to produce a dewaxed lubricating oil which comprises first, solvent treating a paraffinic wax-containing lubricating oil having a waxy substrate therein, at solvent treating conditions, with a solvent consisting essentially of methylisopropyl ketone and an aromatic hydrocarbon selected from the group consisting of benzene, toluene, xylene and cumene to produce a solvent dewaxing product stream containing solvent and partially dewaxed lubricating oil and a slack wax stream containing said solvent and said paraffinic wax compounds; separating said partially dewaxed lubricating oil from said slack wax stream; second, separating said solvent from said partially dewaxed lubricating oil; and third, catalytically treating said partially dewaxed lubricating oil in a catalytic treating zone in the presence of a dewaxing catalyst at catalytic treating conditions to produce a dewaxed lubricating oil.

2. The process as set forth in claim 1 further characterized in that said slack wax stream comprises said methylisopropyl ketone in admixture with toluene in addition to lubricating oil containing said paraffinic waxes.

3. The process as set forth in claim 1 further characterized in that said solvent treating conditions include a filtration temperature below 20° F. and a solvent to waxy lubricating oil ratio of 0.5:1 to 5:1 by volume.

4. The process as set forth in claim 1 further characterized in that said catalytic treating conditions include a temperature of from about 450° F. to about 900° F. and a pressure of from about 7 atmospheres to about 205 atmospheres.

5. The process as set forth in claim 2 further characterized in that said methylisopropyl ketone and said aromatic hydrocarbon are present in a volume percent ratio of 25:75 to 99:1 to 1 volume percent aromatic hydrocarbon.

6. The process as set forth in claim 1 further characterized in that said paraffinic wax-containing lubricating oil is a Bright Stock lubricating oil containing $C_{20+}$ paraffins as the waxy substrate.

7. The process as set forth in claim 1 further characterized in that said paraffinic wax-containing lubricating oil is an HVI 80–150 lubricating oil containing $C_{15+}$ paraffins as said waxy substrate.

8. The process as set forth in claim 1 further characterized in that said paraffinic wax-containing lubricating oil is an HVI 250–300 lubricating oil containing $C_{20+}$ paraffins as said waxy substrate.

9. The process as set forth in claim 1 further characterized in that said dewaxing catalyst is a ZSM-5 zeolite.

10. The process as set forth in claim 1 further characterized in that said dewaxing catalyst is a synthetic ferrierite having catalytic metals incorporated therewith.

11. In a process for the combinative dewaxing of a lubricating oil having a wax content which comprises:

(a) contacting a waxy lubricating oil with a solvent comprising a ketone and an aromatic hydrocarbon selected from the group consisting of benzene, toluene, xylene and cumene in a solvent dewaxing zone, at solvent dewaxing conditions, to produce a partially dewaxed lubricating oil containing said ketone and said aromatic hydrocarbon and a slack wax stream containing hard wax, soft wax containing lubricating oil therewith, ketone, and aromatic hydrocarbon;

(b) passing said partially dewaxed lubricating oil and slack wax stream to a first separation zone, and separating therein said partially dewaxed lubricating oil from said slack wax stream;

(c) removing said ketone and said aromatic hydrocarbon from said partially dewaxed lubricating oil and contacting said partially dewaxed lubricating oil with a dewaxing catalyst, in a catalytic dewaxing zone, at catalytic dewaxing conditions, to produce a dewaxed lubricating oil;

(d) treating, in a second dewaxing zone, said slack wax stream to separate said hard wax from said soft wax containing lubricating oil and said ketone solvent and said aromatic hydrocarbon from said slack wax stream;

(e) recycling at least a portion of said ketone and aromatic hydrocarbon from step (d) to said solvent dewaxing zone of step (a) or said second dewaxing zone of step (d); and (f) passing said soft wax containing lubricating oil to a catalytic dewaxing zone to convert said soft wax and to thereby increase the produced quantity of lubricating oil; the improvement which consists of use of methylisopropyl ketone as said solvent ketone in the solvent dewaxing zone of step (a).

12. The process of claim 11 where said catalytic dewaxing zone of step (f) and said catalytic dewaxing zone of step (c) are the same zone.

13. The process of claim 11 further characterized in that said lubricating oil is a deasphalted bright stock containing $C_{20+}$ paraffinic material as said wax.

14. The process of claim 11 further characterized in that said solvent dewaxing conditions include a filtration temperature of below 20° F. and a solvent to waxy lubricating oil ratio of from 0.5:1 to 5.0:1 by volume.

15. The process of claim 11 further characterized in that said catalytic treating conditions include a temperature of from about 450° F. to about 900° F. and a pressure from about 7 atmospheres to about 205 atmospheres.

16. The process of claim 11 further characterized in that said dewaxing catalyst is selected from the group consisting of a ZSM-5 zeolite, a ZSM-35 zeolite, and a synthetic ferrierite having a catalytic metal deposited therewith.

17. The process of claim 11 further characterized in that the ratio on a volume percent basis, of the methylisopropyl ketone to the aromatic hydrocarbon is present in amounts of from 25:75 to 99:1 on a basis of total solvent.

* * * * *